United States Patent [19]

Trumper et al.

[11] 4,451,181

[45] May 29, 1984

[54] CONTROL SYSTEMS FOR MINERAL MINING INSTALLATIONS

[75] Inventors: Thomas Trumper, Werne; Harry Rosenberg, Ludinghausen; Walter Weirich, Dortmund, all of Fed. Rep. of Germany

[73] Assignee: Gewerkschaft Eisenhutte Westfalia, Lunen, Fed. Rep. of Germany

[21] Appl. No.: 361,182

[22] Filed: Mar. 24, 1982

[30] Foreign Application Priority Data

Mar. 26, 1981 [DE] Fed. Rep. of Germany ..... 3111875

[51] Int. Cl.[3] ..... E21D 23/12; F15B 11/20

[52] U.S. Cl. ..... 405/302; 91/427; 91/527; 405/291

[58] Field of Search ..... 405/302, 291–296; 91/170 MP, 427, 527, 531

[56] References Cited

U.S. PATENT DOCUMENTS

| | | | |
|---|---|---|---|
| 3,198,083 | 8/1965 | Farr et al. | 91/527 |
| 3,259,024 | 7/1966 | Kibble et al. | 405/302 |
| 3,272,084 | 9/1966 | Bolton et al. | 91/170 MP |
| 3,320,001 | 5/1967 | Allen et al. | 405/302 |
| 3,405,608 | 10/1968 | Teale | 91/531 |
| 3,589,241 | 6/1971 | Bolton et al. | 91/531 |
| 3,906,738 | 9/1975 | Weirich et al. | 91/427 |
| 4,159,671 | 7/1979 | Allen | 91/427 |

*Primary Examiner*—Dennis L. Taylor

*Attorney, Agent, or Firm*—Thompson, Birch, Gauthier & Samuels

[57] ABSTRACT

An electro-hydraulic control system for an underground mineral mining installation employs individual control assemblies and devices on a series of support units which are interconnected to one another and to a central control station via lines conveying electrical control signals. Manually-operable selector switches on the units enable groups of the support units to be operated in sequence at will by operating the switches of adjacent units outside the group.

5 Claims, 1 Drawing Figure

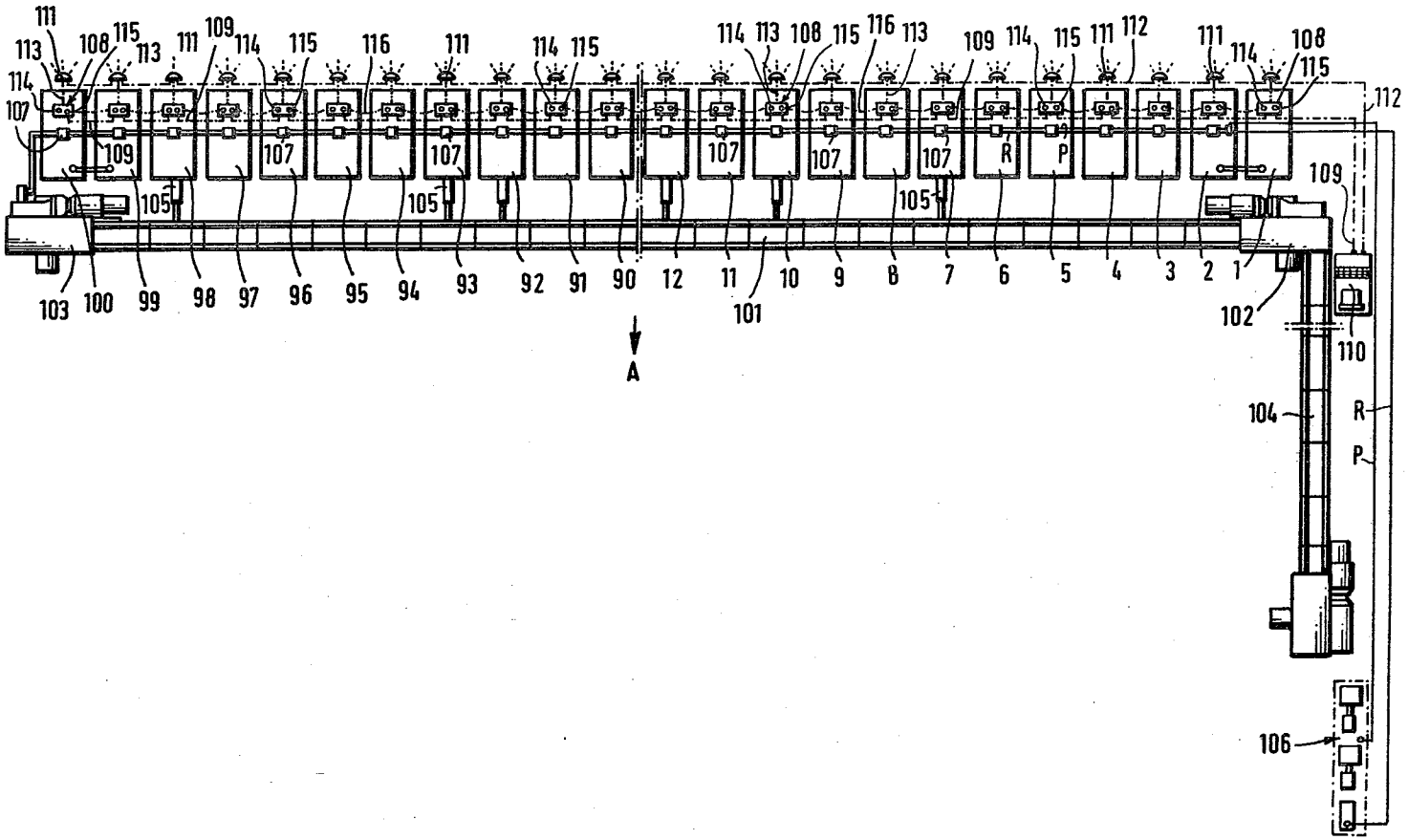
A
R
P
101
102
103
104
105
106
107
108
109
110
111
112
113
114
115
116

CONTROL SYSTEMS FOR MINERAL MINING INSTALLATIONS

BACKGROUND TO THE INVENTION

The present invention relates in general to mineral mining installations and more particularly, to electro-hydraulic control systems for such installations.

Control systems providing local, remote and/or automatic control function of various kinds are known in the art. Typically, support units arranged along the mine working are provided with individual hydraulic valve blocks or assemblies which are associated with electromagnetic solenoid valves and which connect consumer appliances associated with units to common pressure fluid feed and return lines. These lines extend along the working and connect with a pump and fluid reservoir at one end of the working or in an adjacent roadway. Where remote control is to be effected a control station conveniently in the roadway, is linked to the units via electrical control lines. In modern systems, electronic devices, which may include microprocessors, are also provided and which are programmed to initiate specific control sequences in conjunction with position and other monitoring equipment. The desired operating sequence comprising for example, the relief or retraction of the hydraulic props of a unit, its shifting and the extension and re-setting of its props can be controlled directly by an operator actuating manual controls on the unit in question. To ensure safety, such local control can be made dependent on the reception of an enabling control signal from the central control station. In the context of sequence control, a group of units is made to perform a succession of automatic operations in sequence and such sequence control can take a variety of forms. For example, the control can be effected hydraulically, pneumatically or electrohydraulically and the necessary supervision can rely on the detection of fluid pressure levels, on position sensing and/or in dependence on time intervals. (see German published specification Nos. 2212686, 1196150 and 2038661 and the Journal "Glückauf" 1965 pages 860–867). Conventionally with sequence control, the group of units is pre-determined and fixed so that it is only possible to shift supports over a certain section of the working.

A general object of the present invention is to provide an improved control system for a mineral mining installation.

SUMMARY OF THE INVENTION

The present invention provides an electrohydraulic control system for a mineral mining installation which employs a series of shiftable support units with associated hydraulic consumer appliances arranged side-by-side along a mine working; said system comprising pressure fluid feed and return lines, control means on each unit, each said control means including hydraulic valves and solenoid valves which serve to connect the appliances associated with the unit selectively to the feed and return lines and electronic control devices programmed to caused predetermined sequence of operations to be performed affecting one or a group of units, and a remote control station linked to all the control means via a line for conveying electrical control signals. According to the invention, selector switches are provided for the control means of the units, the selector switches being accessible for direct local actuation by an operator and arranged to permit said operator to initiate a sequence of automatic operations on any selected group composed of a number of units by actuating one of the selector switches which is associated with the control means of a support unit not in the selected group but adjacent thereto. Instead of having fixed groups, the invention makes it possible to vary the group of units on which the automatic sequence is performed. This can be accomplished without altering the number of units in each group. To provide adequate safety for the operation the one selector switch which serves to initiate the sequence of operations on said group of units is associated with the control means of a unit at least spaced next but one to a unit at one end of said group. To provide for bi-directional sequence control each unit may have two selector switches one initiating a sequence of operations on a group of units in one direction along the working and the other serving to initiate a sequence of operations on a different group of units in the opposite direction to said one direction.

The invention also provides a method of controlling the operation of a mineral mining installation which employs a series of shiftable support units with associated hydraulic consumer appliances arranged side-by-side along a mine working with the aid of an electrohydraulic control system with pressure fluid feed and return lines, control means on each unit with hydraulic valves and solenoid valves for selectively connecting the appliances to the feed and return lines and electronic control devices programmed to cause a pre-determined sequence of operations to be performed on one or a group of units and a central control station providing electrical control signals to the control means; said method comprising manually-actuating a selector switch of the control means of one of the units to initiate a sequence of automatic operations on a selected group of units adjacent to said one unit.

In contrast to the prior art fixed group control, a number of units, say six to twelve, are collectively denoted as a group but independently of the number of units in the group the choice of the first unit is variable by a factor of one or a multiple thereof. For example, if the support units along the working are assigned the numbers 1, 2, 3 etc and a group for sequence control purposes comprises say eight side-by-side units, by operating the appropriate selector switch it is possible to choose the units 10 to 17 or 11 to 18 12 to 19 or 13 to 19, for example, to form the group which then performs the sequence of operations under control of the pre-set programme and monitoring equipment. It is also possible to reverse the direction of the sequence so that the selected group, say 11 to 18, performs the sequence in a reverse sense commencing with unit 18 and finishing with the unit 11. By enabling the selection of the group to be achieved simply by actuating the appropriate switch on the unit outside the group but adjacent thereto, say by actuating the switch of the control means of unit 20 to initiate the sequence on units 21 to 28 or 22 to 29 or 19 to 12 or 18 to 11, the control is considerably improved. This method of control is thus very versatile and enables the operator to adapt the mineral winning progress to the prevailing conditions.

As mentioned previously, it is best to separate the first unit of the selected group from the unit on which the switch is actuated by another unit which remains set against the roof. It is however possible in certain conditions to provide two or more safe intermediate units between the first unit of the selected group and the unit on which the switch is actuated. To increase safety the control station preferably provides a master enabling signal the absence of which will inhibit the sequence of operations from occurring even if the appropriate switch is operated locally.

The electronic control devices are preferably linked to one another and to the control station by cables or the like transmitting the electrical control signals. Conveniently the electrical power for operating the solenoid valves and for operating the control devices is derived from the lighting system in the working. One or more transformers would transform the electrical power for the lamps of the lighting system to an intrinsically safe level and this is especially suitable for driving the solenoid valves and for conversion to d.c. to operate the elctronic control devices.

The invention may be understood more readily, and various other aspects and features of the invention may become more apparent, from consideration of the following description.

An embodiment of the invention will now be described, by way of example only, with reference to the accompanying drawing which is a diagrammatic representation of the mineral mining installation employing a control system in accordance with the invention.

As shown in the drawing, a longwall underground mineral face mine working contains a scraper-chain conveyor 101 composed of a series of channel sections or pans arranged end-to-end and along which is circulated a scraper-chain assembly. The scraper-chain assembly is driven by drive means at a main drive station 102 and at an auxiliary drive station 103. The drive stations 102, 103 are located at the end regions of the longwall working. A mineral winning machine (not shown), for example a plough or shearer, is guided for movement along the conveyor 101 to win mineral from the working face. The material thus detached from the face is transported away by the conveyor 101 towards the main drive station 102 and the material is transferred here to a roadway or an intermediate conveyor 104.

A series of support units 1 to 100 are disposed side-by-side along the working on the goaf side of the conveyor 101. For convenience, only some of the units—those designated 1–12, 90–100—are shown in the drawing. The end most units 1 and 100 are located in the regions of the main and auxiliary drive station 102, 103 respectively. The units 1 to 100 can be of any known design and generally each unit comprises a floor-engaging structure, a roof-engaging structure and hydraulic props therebetween. The units 1 to 100 may employ goaf shields, as are known. Each unit 1 to 100 is connected to the conveyor 101 with the aid of a hydraulic ram 105 and for the sake of clarity only some of the rams 105 are shown in the drawing. The rams 105 enable the conveyor 101 to be shifted in sections in the advancement direction A according to the winning progress and the individual units 1-100 to be drawn up to follow the advancement of the associated section of the conveyor 101.

In the lower gate roadway (to the right of the drawing), a motor driven pump and a reservoir or storage vessel are provided as a unit 106 to supply the hydraulic pressure fluid to the various consumer appliances in the installation. The feed line for supplying high pressure fluid from the pump is designated P while the return line leading back to the reservoir is designated R. Conveniently, the lines P, R can take the form of hoses or conduits laid along the working. The lines P, R connect with the props of the units 1 to 100, the rams 105 and other appliances such as piston and cylinder units used for adjusting the position of gap covers between the units 1 to 100 and/or for adjusting the position of roof-bar extensions as well as devices for anchoring or bracing the conveyor and for other purposes.

The operation of the installation is controlled in a manner permitting direct local or remote control. The latter control is effected by way of a control station 110 in the lower gate roadway. Each unit 1 to 100 has control means in the form of a hydraulic valve assembly or block 107 connected to the pressure and return lines P, R and an associated electronic control device 108 which is programmed to actuate solenoid valves by electrical control signals thereby to operate the valves in the units 107. These solenoid valves can form components of the assembly 107 or of the devices 108.

The devices 108 are inter-connected one to another by way of electrical control signal lines 116 and thence to the control station 110 by way of an electrical control signal line 109. The latter transmits master control signals which control or co-ordinate the transmission of control signals between the units 108. The lines 116, 109 would take the form of multi-core cables in individual sheathings or in a common sheathing.

Each unit 1 to 100 is provided with a lamp 111 serving to illuminate part of the working. Conveniently, the lamps 111 can be arranged on the roof-engaging structures of the units 1 to 100. The power for the lamps 111 is supplied from the station 110 via a line 112 which also extends along the working. The electrical power for driving the units 108 and for actuating the associated solenoid valves can be taken from the individual lamps 111 or from one or more common lamps 111 as indicated generally by the lines 113. At least one of the lamps 111 contains in a housing, a transformer for converting the electrical power to a safe level for direct utilisation in the control system in the working.

In general, and as is known in the art, the operation of the units 1–100 can be controlled from the control station 110 and/or by means of local selector switches on the units 1–100. The control sequences can be made inter-dependent and the system-related control is programmed for single-sequence control of the respective individual support units as well as group sequence control with the group functions, i.e. those effecting more than one unit, being co-ordinated centrally from the station 110. The different programmes or sequences can be initiated locally and manually by the selector switches while the station 110 then supervises and controls the overall operation in accordance with stored programmes. The performance of an operating sequence is also subjected to the reception of a master control signal or enabling signal generated by the control station 110. It follows that the control station 110 contains a suitable electronic programme which monitors and controls the sequence of operations and is linked to the devices 108 and to the switches.

As shown in the drawing, the housing of the electronic control device 108 of each support unit 1 to 100 is provided with two such selector switches 114 115 accessible for manual operation. All the operating sequences are then initiated by a manual operation of the switches 114, 115 subject to the master or enabling control signal.

A number of the units 1 to 100 composed of say, some six to twelve individual units are combined to form one group for group sequence control purposes. The operations which make up the full working cycle associated with the group is initiated by manual operation of one of the selector switches 114, 115 of a unit outside the group but adjacent thereto. The individual units of the group will then perform their own operations in succession and the shifting of any one unit can only occur after the preceding unit has finished its full operational cycle and more particularly has been braced between the roof of the floor through extension of its props. If the units 5 to 10 form such a single group the operative sequences associated with this group would be initiated by manual operation of the selector switch 114 on the unit 3. Once the enabling signal has been received from the control station 110 each of the units 5 to 10 will perform in sequence an operational cycle at least comprising: retraction of the props of the unit, the advancement of the thus-relieved unit in the direction of arrow A with the aid of the ram 105 and the extension of the props to brace the unit between the roof and the floor. During this operative cycle, the support units 4 and 3 remain set and provide adequate safety for the operator operating the switch 114 on the unit 3 while the units 5 to 10 are shifted up in the direction of arrow A. Any selected group of units can be shifted in this manner, so for example, if the units 6 to 11 are to be shifted the switch 114 on the unit 4 will be operated and if the units 92 to 97 are to be shifted the switch 114 on the unit 90 will be operated. It is also possible to reverse the sequence so that the units are shifted in descending numerical order by operating the switch 115 on the appropriate unit instead of the switch 114. Thus, if the switch 115 on the unit 12 is operated, and assuming that the group is again composed of six units spaced from the operator-controlled unit by the ordinal 2, then the units 10 to 5 will be shifted up in succession. Thus bi-directional sequential control can be realised.

The control system in accordance with the invention makes it possible to adapt the winning progress to the prevailing conditions. If, for example, the face is being won in sections instead of along its entire length the appropriate group of units 1–100 and conveyor section can be shifted up rapidly to ensure adequate support for the exposed roof.

We claim:

1. In an electro-hydraulic control system for a mineral mining installation which employs a series of shiftable support units with associated hydraulic consumer appliances arranged side-by-side along a mine working: said system comprising pressure fluid feed and return lines, control means on each unit, each said control means including hydraulic valves and solenoid valves which serve to connect the appliances associated with the unit selectively to the feed and return lines and electronic control devices programmed to cause a predetermined sequence of operations to be performed affecting one or a group of units, and a remote control station linked to all the control means via a line for conveying electrical control signals; the improvement comprising selector switches are provided for the control means of the units, the selector switches being accessible for direct local actuation by an operator and arranged to permit said operator to initiate a sequence of automatic operations on any selected group composed of a number of units by actuating one of the selector switches which is associated with the control means of a support unit that is outside of and separated from the selected group by at least one intermediate unit.

2. A control system according to claim 1, wherein the control means of each unit is provided with two said selector switches one serving to initiate a sequence of operations on a group of units in one direction along the working and the other serving to initiate a sequence of operations on a different group of units in the opposite direction to said one direction.

3. A control system according to claim 1, wherein the control means of the units are interconnected with lines for conveying control signals as well as to the control station and the control station provides a master enabling signal the absence of which will prevent the sequence of operations from occurring.

4. A control system according to claim 3, wherein the units have lamps and the electrical power supply for the control means is derived from that for the lamps.

5. A method of controlling the operation of a mineral mining installation which employs a series of shiftable support units with associated hydraulic consumer appliances arranged side-by-side along a mine working with the aid of an electro-hydraulic control system with pressure fluid feed and return lines, control means on each unit with hydraulic valves and solenoid valves for selectively connecting the appliances to the feed and return lines and electronic control devices programmed to cause a pre-determined sequence of operations to be performed on one or a group of units and a central control station providing electrical control signals to the control means; said method comprising manually-actuating a selector switch of the control means of one of the units to initiate a sequence of automatic operations on a selected group of units, the said one unit being outside of and separated from the selected group of units by at least one intermediate unit.

* * * * *